United States Patent [19]

Saito et al.

[11] 4,015,982

[45] Apr. 5, 1977

[54] MOLD FOR CONTINUOUS CASTING PROCESS

[75] Inventors: Katashi Saito; Kiminari Kawakami; Moriyuki Ishiguro, all of Hiroshima, Japan

[73] Assignee: Nippon Kokan Kabushiki Kaisha, Tokyo, Japan

[22] Filed: July 29, 1975

[21] Appl. No.: 599,995

Related U.S. Application Data

[63] Continuation-in-part of Ser. No. 504,144, Sept. 9, 1974, abandoned, which is a continuation of Ser. No. 338,640, March 6, 1973, abandoned.

[30] Foreign Application Priority Data

Mar. 7, 1972 Japan ..... 47-22784

[52] U.S. Cl. ..... 75/156.5; 75/153; 75/154; 75/156; 75/157.5; 75/159; 75/160; 75/163; 164/273 R

[51] Int. Cl.[2] ..... C22C 9/00; C22C 9/04

[58] Field of Search ..... 75/157.5, 156.5, 153, 75/154, 156, 159, 160, 163; 249/135; 164/82, 38, 273 R, 283 R, 283 M

[56] References Cited

UNITED STATES PATENTS

| | | | |
|---|---|---|---|
| 2,061,921 | 11/1936 | Ro ath | 75/157.5 |
| 2,101,930 | 12/1937 | Davis et al. | 75/157.5 |
| 2,169,188 | 8/1939 | Kelley | 75/157.5 |
| 3,336,973 | 8/1967 | Ratcliffe | 249/135 |

FOREIGN PATENTS OR APPLICATIONS

| | | | |
|---|---|---|---|
| 598,419 | 5/1960 | Canada | 164/82 |
| 1,458,322 | 10/1968 | Germany | 75/157.5 |

*Primary Examiner*—Arthur J. Steiner
*Attorney, Agent, or Firm*—Moonray Kojima

[57] ABSTRACT

This invention relates to an improved mold for continuous casting process, wherein a metallic material having cooling capacity of 0.1 to 0.7 [cal/(cm$^2$ ·°C · $\sqrt{\text{sec}}$)] and thermal conductivity (λ) of 0.3 to 0.7 [cal/(cm·sec·°C)] is used as a mold whereby surface checkings such as tortoise shell patterns or cracks are prevented from occuring.

10 Claims, 3 Drawing Figures

Average Number of Surface Checkings
100
50
0
30
60
90
120
A Number of Heats

Scarfing Rate (%)
5
4
3
2
1
0
30
60
90
120
A Number of Heats
o The Prior Mold (Copper)
o This Invention Mold (Brass)
x This Invention Mold (Cu-Fe System)

MOLD FOR CONTINUOUS CASTING PROCESS

BACKGROUND OF THE INVENTION

This is a continuation in part of Ser. No. 504,144 filed Sept. 9, 1974 which is a continuation of Ser. No. 338,640 filed Mar. 6, 1973, both of which are now abandoned.

This invention relates to an improved mold for continuous casting process wherein the cooling capacity and thermal conductivity of the mold are controlled to enable casting of a sound metallic material, that is, the surface does not need to be conditioned.

In known continuous casting molds, a mold is made of copper in view of the thermal conductivity and mechanical strength thereof. It is well known that the cast metal surface, especially steel, requires conditioning, e.g. scarfing, since many surface checkings, e.g. tortoise shell patterns or cracks which reach a depth of several millimeters, appear on the cast piece when a large piece of heavy plate of the 40 Kg class or high tension steel of the 50 Kg class is cast. It is needless to state that the above conditioning increases cost of manufacture, lowers yield and brings about other manufacturing losses. Thus, many countermeasures have been carried out to avoid such losses. For example, a Mo or Cr coated mold, or a mold having its lower portion altered with iron, has been developed and used. It is however, well known that many defects exist with the above prior molds. That is, the coating of Mo or Cr on the mold surface is itself troublesome and wear resistance of the coated layer is low. Secondly, the coated layer tends to become stripped. For example, the Mo coating layer strips after being used about 30 heating cycles. In case of Cr coating, even if the coating layer has a thickness of 0.05 to 0.1 mm, the layer strips after about 120 heating cycles. In other words, effect of coating the mold surface is poor in durability. Many technical difficulties are seen in altering the lower portion of the mold with iron, especially such as used for a large slab of more than 40 Kg/cm², whatever may be the case at a small bellet. Thus, it is the present situation that a mold is not available which does not disadvantageously influence the surface quality of the cast metal.

SUMMARY OF THE INVENTION

This invention was developed to overcome the above and other problems and defects and disadvantages of the prior art. A feature of the invention encompasses a continuous casting mold made of a metal having a cooling capacity (K) of 0.1 to 0.7 [Cal/(cm²·° C· $\sqrt{\text{sec}}$)] and a thermal conductivity (λ) of 0.3 to 0.7 [Cal/(cm·sec·° C)].

An object of this invention is to provide an improved mold which does not impart adverse characteristics to the surface of a continuously cast metallic material, by controlling the cooling capacity and thermal conductivity of the mold.

Other objects and advantages and features of the invention will become more apparent from the following drawings and detailed description.

DETAILED DESCRIPTION OF PREFERRED EMBODIMENTS

Figures 1, 2:
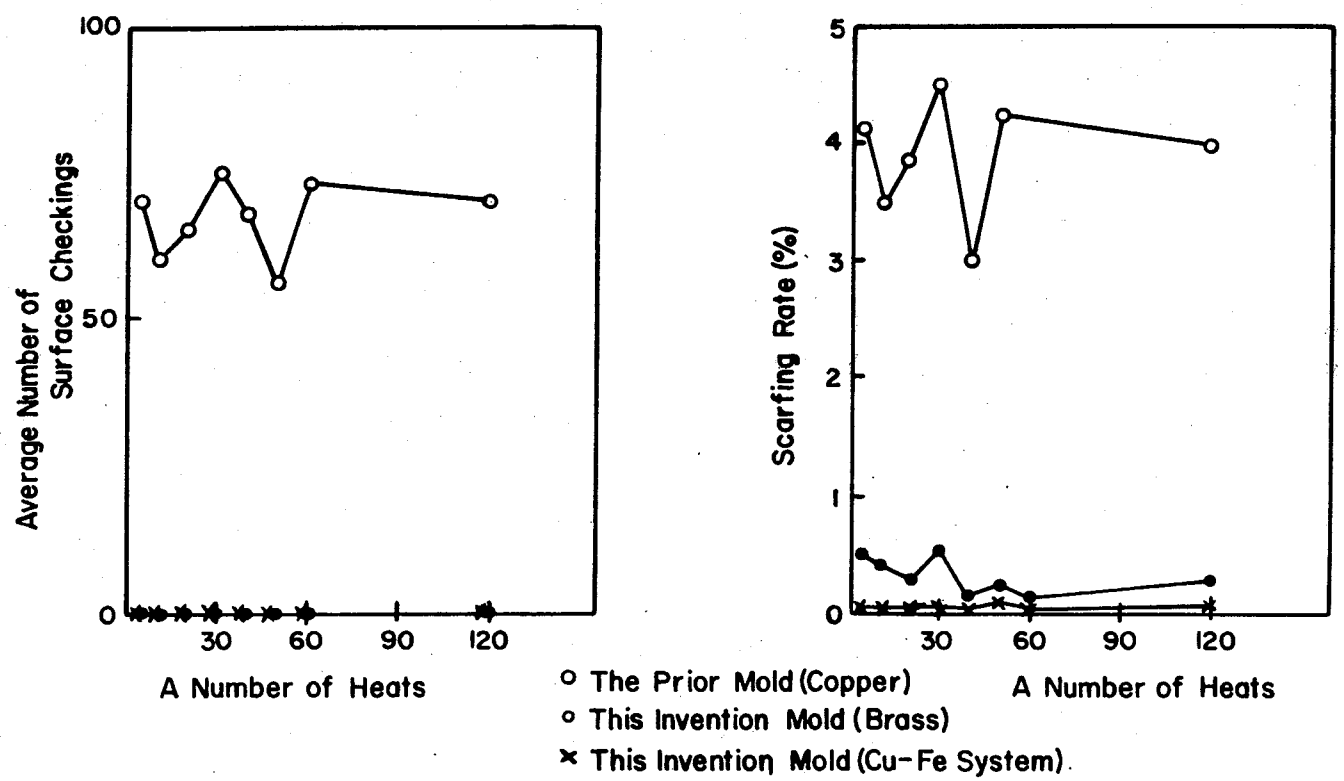
FIG. 1 depicts the average number of surface checkings of pieces continuously cast using the mold of this invention as compared to those produced using prior art molds, and for the same number of uses of the molds.
FIG. 2 depicts the scarfing rate of this invention as compared with that of the prior art molds for the same number of uses of the molds.

It has been up to now reasoned that occurence of known surface checkings on continuously cast pieces were due to the copper component of the mold adherring to the piece and then penetrating into the grain boundary. Thus, certain countermeasures, such as those above mentioned, were employed in an attempt to overcome the above deficiency. There was an assumption that copper, of which the prior molds were made, exists in the surface checkings of the pieces. However, according to many examinations of cracks of typical surface checkings appearing on continuously cast large slabs, it was confirmed that very high concentration of copper was non-existent in any of the cracks. Accordingly, the above mentioned reasoning was erroneous. That is to say, rapid cooling of the cast pieces, owing to local contact with the mold made of copper, was the cause of the surface checkings, was not correct. Judging from the above discussed facts, it should be noted that the decrease of the surface checkings in the case of Mo or Cr coating mold was due to the cooling capacity of the coating layer being lower than that of the copper. Thus, it can be understood that a mold for continuous casting process should be made of a metal having a lower cooling capacity than that of copper.

According to many experiments, it was confirmed that the cooling capacity is given by the following formula:

heat penetration rate (K) = $\sqrt{\lambda \rho cp}$ where λ = thermal conductivity; ρ = density; and cp = specific heat.

The above physical properties of typical metals at 25° C are as follows:

TABLE 1

(Cooling Capacity at 25° C)

| | ρ(g/cm³) | C(Cal/g° C) | λ(Cal/cm.sec.° C) | K ( $\sqrt{\lambda \rho cp}$ ) |
|---|---|---|---|---|
| Cu | 8.96 | 0.093 | 0.94 | 0.885 |
| Mo | 10.2 | 0.061 | 0.35 | 0.467 |
| Steel | 7.87 | 0.11 | 0.18 | 0.395 |
| Cr | 7.19 | 0.11 | 0.16 | 0.356 |
| Brass | 8.92 | 0.09 | 0.62 | 0.7 |

As shown in Table 1, both ρ and cp of the usual metals are nearly similar in value. Accordingly, it will be understood that cooling capacity of metals depends upon thermal conductivity for the most part. To put it concretely, it will stand to reason that the cooling capacity of metal of which the mold is made is decided by the K value at the surface temperature of the mold. However, the physical properties at surface temperature of the mold is difficult to measure, and consequently is not clear. Thus, cooling capacity at 25° C was investigated as shown in above Table 1. Through the experiments, in which molds made of each of the above metals were employed, the most suitable range of cooling capacity and thermal conductivity to avoid the producing of surface checkings on cast pieces, was ascertained respectively. That is, the most suitable value of cooling capacity (K) is within the range of 0.1 $\leqq K \leqq 0.7$ [Cal/cm$^{2}$·° C· $\sqrt{\text{sec}}$)] and that of thermal conductivity (λ) is within the range of $0.3 \leqq \lambda \leqq 0.7$ [Cal/cm·sec·° C)]. The upper limit of the range was decided upon to obtain sound surface quality of cast pieces with little or no conditioning. When either K or is beyond the upper limit, increase of surface checking is unavoidable since the cooling property becomes too much. The lower limit of the ranges were decided upon for the reason that, even if the surface checkings are decreased, surface quality becomes worse conversely since the boundary between the mold and molten metal is disturbed. Consequently, the molten metal sticks to the mold. It is needless to say that such behaviour makes it impossible to continue the casting operation.

The structure of metals having the above mentioned cooling capacity (K) and thermal conductivity (λ) will be referred to in detail.

Cu: With regard to the pure copper made mold generally used, surface checkings on the continuously cast pieces have been discussed. In this regard, it has been found that additions of other components of small amounts (around as impurities) to the copper component contributed to great improvements of the cooling capacity and thermal conductivity. The results are shown in Table 2.

TABLE 2

(Cooling Capacity at 25° C)

| Component system | ρ(g/cm³) | C(Cal/g.° C) | λ(Cal/sec.° C) | $\sqrt{\lambda\rho\ Cp}$ |
|---|---|---|---|---|
| Cu-Fe Fe = (0.01–0.1%) | 8.96 | 0.093 | 0.3–0.7 | 0.5–0.7 |
| Cu-P P = (0.02–0.1%) | 8.96 | 0.093 | 0.3–0.7 | 0.5–0.7 |
| Cu-Si Si = (0.03–0.1%) | 8.96 | 0.093 | 0.3–0.7 | 0.5–0.7 |
| Cu-AS AS = (0.05–0.1%) | 8.96 | 0.093 | 0.3–0.7 | 0.5–0.7 |
| Cu-Sb Sb = (0.07–0.1%) | 8.96 | 0.093 | 0.3–0.7 | 0.5–0.7 |

Figure 3:
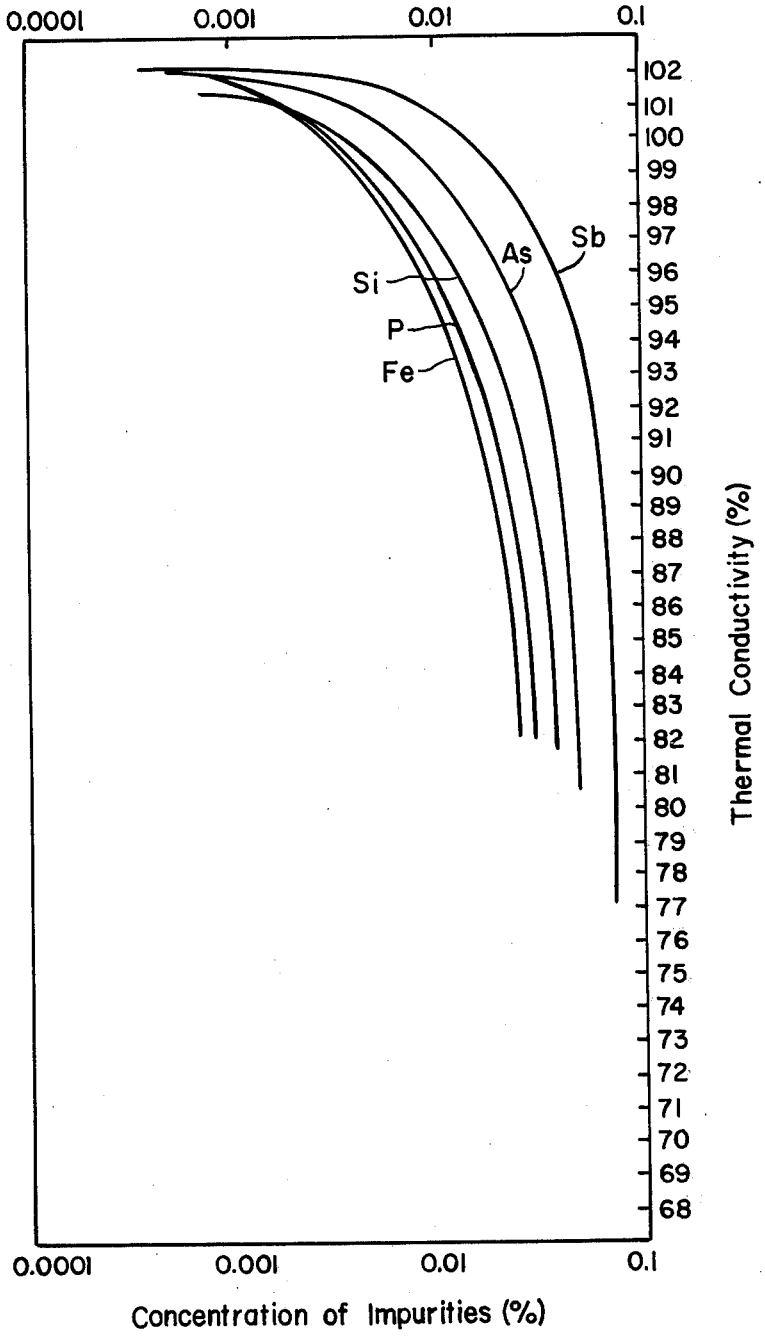
FIG. 3 depicts changes of the thermal conductivity when other components are added to copper.

Changes of the thermal conductivity due to the other components are shown in FIG. 3. It is seen with reference to Table 2 and FIG. 3 that when the above shown components are added to pure copper as shown above, desired cooling capacity and thermal conductivity are easily obtained. In such cases, it is quite enough to add one component, and many experiments have confirmed that more than two may be added wherein the total amount is controlled to be within the range of 0.01 to 0.1%, by weight. (the percents are always in terms of weight herein).

Mo: Disadvantages involved in coating of the molybdenum component has been mentioned. However, its physical properties are suitable for the continuous casting mold as shown in Table 1. Thus, this component may be employed if desired.

Steel: The physical properties in Table 1 are cited from the ordinary structural steel prescribed by ASTM A-6. The mold consisting of such component system may avoid probable surface cracks as in the conventional molds.

Cr: Disadvantages involved in coating of the chromium component has been mentioned. Similarly to the molybdenum component, the physical properties of the Cr made mold is suitable, as shown in Table 1, for avoiding occurrences of crackings. Taking into consideration that the Cr made mold is expensive as the Mo made mold, the well known 13% Cr steel or 18 Cr—8Ni steel are practicable except for special cases. According to the experiments carried out by the inventors, the molds of these systems stand on the same level of the physical properties as by the present invention.

Brass: The characteristic values of the brass in Table 1 are cited from the component systems of ASTM B-30 (high Cu class). Among many brasses, the molds by these components show the desired physical properties, and are very useful for avoiding occurrences of cracks.

As discussed above, the practical structures of the metals for the molds may be appropriately selected, depending on the scale of the continuous casting apparatus to be worked, conditions of the cast pieces to be obtained and others. IN summary, the components should be controlled within the limits with regard to the above cooling rate and thermal conductivity, whereby the sound continuous casting without surface cracks can be easily accomplished.

It was also discovered that the following component systems having the cooling capacity and thermal conductivies within the above discussed limits produced the desired results:

Fe, Ni and Co, total 0.01 to 0.1%, remainder Cu.

Si, Sn and Pb, total 0.3 to 0.17%, remainder Cu.

Sb and B, total 0.07 to 0.1%, remainder Cu.

More than two of Fe, P, Si, As, Sb, Ni, Co, Bi, Sn and Pb, total 0.01 to 0.1%, remainder Cu.

Thus, when a mold is made of a metal of which the K value and λ valve are within the range recited, respectively, the cast piece does not have to be after conditioned. Examples based on this invention have been discussed above and also are as follows. In the preferred embodiments, the mold is made of usual copper and brass, respectively, as shown in Table 1. The operating requirements are shown in Table 3 hereinbelow.

TABLE 3

(Operating Requirements)

| Type of Steel | High Tension Steel 50 Kg/cm² | High Tension Steel 50 Kg/cm² |
|---|---|---|
| Slab size | 250 × 2100 mm | 250 × 2100 mm |
| Temperature at tundish | 1440 to 1450° C | 1440 to 1550 ° C |
| Drawing rate | 700 mm/min | 700 mm/min |

TABLE 3-continued

| (Operating Requirements) | | |
|---|---|---|
| Type of Steel | High Tension Steel 50 Kg/cm² | High Tension Steel 50 Kg/cm² |
| mold metal | Brass, K = 0.7 at 25° C | Brass, K = 0.5 at 25° C |
| Length | 700 mm | 700 mm |

An embodiment of the inventive mold was as follows:

TABLE 4

| (ASTM B-146 Brass Casting) | | | | | |
|---|---|---|---|---|---|
| Chemical Composition (%) | | | | | |
| Cu | Zn | Pb | Sn | Al | Fe |
| 83.0 to 88.0 | Remainder | 0.5 max | Total of Sn, Al, Fe to be 1.0 max | | |

| Tension Test | | | |
|---|---|---|---|
| Tensile strength | Elongation | Cooling Capacity | Thermal Conductivity |
| Kg/mm² | (%) | Cal/(cm² · ° C $\sqrt{\text{sec}}$) | Cal/(cm · sec · ° C) |
| 15 min | 15 min | About 0.30 | About 0.34 |

As a result the producing rate and frequency of surface checkings are shown in FIGS. 1 and 2 in comparison with that of usual prior molds, respectively. According to the FIGS. 1 and 2, it can be understood that the mold of this invention shows far more excellent results than that of the prior molds. That is, in the case of this inventive mold, the average number of surface checkings is nearly zero and at most 1 after many uses of the mold; while, in the case of the prior molds, the average number of surface checkings is far more than 50 (See FIG. 1). The scarfing rate for the cast pieces by this inventive mold is below 0.5% after many uses of the mold, while that of the prior mold is 3 to 5%. Thus, according to this invention, a continuously cast piece having sound surface quality can be readily obtained with stability and without the necessity of additional after-conditioning as now required in the prior art.

The foregoing description is for purposes of illustrating the principles of the invention. Numerous other variations and modifications thereof would be apparent to the worker skilled in the art. All such variations and modifications are to be considered to be within the spirit and scope of the invention.

We claim:

1. A continuous casting, consisting essentially of Cu, 83 to 88%; Pb, maximum 0.5%; combination of Sn, Al and Fe, total 1.0% and remainder Zinc; and having a cooling capacity of 0.1 to 0.7 [Cal/(cm²·° C· $\sqrt{\text{sec}}$)] and thermal conductivity of 0.3 to 0.7 [Cal/(cm·sec·° C)].

2. The mold of claim 1, wherein said cooling capacity is between 0.5 to 0.7 [Cal/(cm²·° C· $\sqrt{\text{sec}}$)].

3. A continuous casting mold, consisting essentially of not more than 1% of any one or more of the elements selected from the group consisting of Fe, Ni, Co, P, Si, Sn, Pb, As, Sb, B and Bi, zinc from 0 to 15.5% and remainder copper; and having a cooling capacity of 0.1 to 0.7 [Cal/(cm²·° C· $\sqrt{\text{sec}}$)] and thermal conductivity of 0.3 to 0.7 [Cal/(cm·sec·° C)].

4. The mold of claim 3, consisting essentially of 0.01 to 0.1% of one or more elements selected from the group consisting of Fe, Ni and Co, remainder copper.

5. The mold of claim 3, consisting essentially of P, 0.02 to 0.1%, remainder copper.

6. The mold of claim 3, consisting essentially of 0.03 to 0.17% of one or more elements selected from the group consisting of Si, Sn and Pb, remainder copper.

7. The mold of claim 3, consisting essentially of As, 0.05 to 0.1%, remainder copper.

8. The mold of claim 3, consisting essentailly of 0.07 0.1% of one or more elements selected from the group consisting of Sb and B, remainder copper.

9. The mold of claim 3, consisting essentially of 0.01 to .1% more than two elements selected from the group consisting of Fe, P, Si, As, Sb, Ni, Co, Bi, Sn and Pb, remainder copper.

10. The mold of claim 3, wherein said cooling capacity is between 0.5 to 0.7 [Cal/(cm²·° C· $\sqrt{\text{sec}}$)].

* * * * *